US011306707B2

(12) United States Patent
Paperini et al.

(10) Patent No.: US 11,306,707 B2
(45) Date of Patent: Apr. 19, 2022

(54) METHOD FOR REDUCING THE PULSATION LEVEL IN A MULTI-COMPRESSOR PLANT EMPLOYING RECIPROCATING COMPRESSORS

(71) Applicant: Nuovo Pignone Tecnologie—S.r.l., Florence (IT)

(72) Inventors: Fabio Paperini, Florence (IT); Simone Bassani, Florence (IT); Marco Passeri, Florence (IT); Riccardo Bagagli, Florence (IT)

(73) Assignee: Nuovo Pignone Tecnologie—S.R.L., Florence (IT)

( * ) Notice: Subject to any disclaimer, the term of this patent is extended or adjusted under 35 U.S.C. 154(b) by 25 days.

(21) Appl. No.: 16/567,273

(22) Filed: Sep. 11, 2019

(65) Prior Publication Data

US 2020/0088179 A1 Mar. 19, 2020

(30) Foreign Application Priority Data

Sep. 13, 2018 (IT) ..... 102018000008571

(51) Int. Cl.
*F04B 39/00* (2006.01)
*F04B 35/04* (2006.01)
(Continued)

(52) U.S. Cl.
CPC ..... *F04B 39/0027* (2013.01); *F04B 11/005* (2013.01); *F04B 35/04* (2013.01);
(Continued)

(58) Field of Classification Search
CPC ..... F04B 39/08; F04B 39/0027; F04B 49/02; F04B 49/06; F04B 49/103; F04B 49/065;
(Continued)

(56) References Cited

U.S. PATENT DOCUMENTS 7,600,577 B2 10/2009 Simm et al.
2005/0123407 A1* 6/2005 Schnetzka ..... F04C 29/068 417/53
(Continued)

FOREIGN PATENT DOCUMENTS

CN 1990191 A 7/2007
CN 201608680 U 10/2010
(Continued)

OTHER PUBLICATIONS

International Search Report and Written Opinion for corresponding International Application No. PCT/CN2018/085298, dated Feb. 3, 2019, 8 pages.
"Design of Synchronous Control System of Diaphragm Pump Based on Intersection", by Zhang Yan, Electronic World, Issue 7, p. 133, Apr. 15, 2014, 2 pages.

*Primary Examiner* — Dominick L Plakkoottam
*Assistant Examiner* — Christopher J Brunjes
(74) *Attorney, Agent, or Firm* — Mintz Levin Cohn Ferris Glovsky and Popeo, P.C.

(57) ABSTRACT

It is disclosed a method for reducing the pulsation level in a multi-compressor plant where each compressor of a plurality of compressors is driven by a respective motor. The method manages to reduce the pulsation level by starting a first motor of a first compressor and then starting in succession each one of the other motors in a way to synchronize all motors between each other with a specified phase shift.

11 Claims, 8 Drawing Sheets

(51) Int. Cl.

| | |
|---|---|
| ***F04B 41/06*** | (2006.01) |
| ***F04B 11/00*** | (2006.01) |
| ***F04B 41/00*** | (2006.01) |
| ***F04B 53/00*** | (2006.01) |

(52) U.S. Cl.
CPC ..... *F04B 41/00* (2013.01); *F04B 41/06* (2013.01); *F04B 53/001* (2013.01)

(58) Field of Classification Search
CPC ..... F04B 2201/12; F04B 2207/01; F04B 35/04; F04B 11/005; F04B 11/00; F04B 41/00; F04B 41/06; F04B 53/001
See application file for complete search history.

(56) References Cited

U.S. PATENT DOCUMENTS

| | | | | |
|---|---|---|---|---|
| 2008/0003094 | A1 | 1/2008 | Celik | |
| 2010/0111713 | A1 | 5/2010 | Chatfield | |
| 2010/0329899 | A1 | 12/2010 | Broerman, III | |
| 2013/0078114 | A1* | 3/2013 | Van Rijswick ..... | F04B 49/20 417/53 |

FOREIGN PATENT DOCUMENTS

| | | | |
|---|---|---|---|
| CN | 102893028 | A | 1/2013 |
| CN | 105443353 | A | 3/2016 |
| CN | 108302022 | A | 7/2018 |
| JP | 2003029879 | A | 1/2003 |
| JP | 5158867 | B2 | 3/2013 |
| JP | 2014009619 | A | 1/2014 |
| JP | 2018059810 | A | 4/2018 |
| WO | 2017018206 | A1 | 2/2017 |

* cited by examiner

METHOD FOR REDUCING THE PULSATION LEVEL IN A MULTI-COMPRESSOR PLANT EMPLOYING RECIPROCATING COMPRESSORS

CROSS-REFERENCE TO RELATED APPLICATIONS

This application claims the benefit of Italian Patent Application No. 102018000008571 filed Sep. 13, 2018, the disclosure of which is herein incorporated by reference in its entirety.

DESCRIPTION

Background

Compressors, in particular reciprocating compressors, may be used in a variety of applications.

For example, reciprocating compressors are used in natural gas facilities, such facilities or plants being connected to a gas grid to provide seasonal storage of natural gas. Principally, gas will be moved into the reservoir during summer, and moved from the reservoir during winter.

As it is known, storage facilities follow the seasonal trend of natural gas demand.

Demand increases in the winter months (greater demand for the domestic sector) and decreases in the warmer months.

A natural gas plant may have three basic operational configurations:

- Injection: Importing gas from the gas grid and injecting using compressors into the depleted gas reservoir via suitable wellheads.
- Production: Exporting stored gas from the reservoir back to the gas grid using the reservoir pressure as free flow.
- Extraction: Exporting stored gas from the reservoir back to the gas grid using the reciprocating compressors in parallel configuration. This mode is used when the reservoir pressure is insufficient to achieve export back to the gas grid under free flow conditions.

When the grid pressure is higher than the wellhead by an adequate margin (~5 bar), free flow into the reservoir is possible.

In systems connected to several reciprocating compressors operating in parallel, the pressure pulsations that propagate on the system is given by the composition of the effects of the pulsations generated by each individual compressor. In case of parallel compressors running at the same RPM, the maximal pressure pulsation levels that may occur is the sum of the pulsations generated by each reciprocating compressor.

Considering that the crankshaft phase among the reciprocating compressors is random, it will change anytime an additional compressor will start, resulting in a pulsations levels that may vary between (theoretically) zero and complete single signal sum. The number of cylinders, the number of active effects and the shafting phase among the cylinders of the same compressor affect the pulsation sum.

The common practice to perform the study of parallel compressors is to consider all the reciprocating compressors working, in the various cases of operations up to the maximum number of usable compressors, imposing to all the reciprocating compressor crankshafts the same phase which is usually the worst case.

Alternatively, an approach used can be to calculate only the single reciprocating compressor contribute and suppose that in the worst case there will be the full sum.

In both cases, as the number of active reciprocating compressors increases, the pressure pulsation sum applied to the system increases proportionally. Then the calculated values, with parallel operation, often exceed current regulations (API618), unless the reciprocating compressors interaction is almost eliminated by plant damping/filtering elements.

Interaction among the reciprocating compressors can be reduced by Big Drum or Separator (of a certain volume located at specific distance from the single compressor to use Helmholtz frequency filter phenomena), but usually in a real plant it is not possible to accommodate these elements unless they are already foreseen for process reasons.

For this reason, the technical standard API618 specifies that pressure pulsation limits may be exceeded, verifying that the resulting forces applied to the piping result in allowable vibrations levels and allowable cyclic stress.

In any case, experiences gained by pulsation studies specialists with thousands of plants studied, suggest that the pressure pulsation calculated sum must never exceed the pressure pulsation value calculated for a single compressor multiplied for the square root of the number of the compressors running in parallel.

An object of the invention is to minimize the pressure pulsation sum given by the reciprocating compressors concurrently operating in a plant.

Another object is to limit the relevant shaking forces in order to limit vibrations in the plant.

These and other objects are achieved by a method having the features recited in the independent claim.

The dependent claims delineate preferred and/or especially advantageous aspects.

BRIEF DESCRIPTION OF THE INVENTION

An embodiment of the disclosure provides a method for reducing the pulsation level in a multi-compressor plant, the multi-compressor plant comprising a plurality of reciprocating compressors connected in parallel to a system, for example to a piping system, and suitable for injecting into and extracting from a reservoir natural gas, each reciprocating compressor being driven by a respective motor, the method comprising a step of starting a first motor of a first reciprocating compressor and a step of starting in succession each other motors in order to synchronize all motors between each other with a specified phase shift.

An advantage of this embodiment is that it allows to design a system capable to synchronize the start-up of multiple reciprocating compressors driven by electric motors and operating in parallel within the same plant so that the phasing of different compressor crankshaft is set up to a prior calculated value to minimize the generated pressure pulsation level in the plant.

This functionality is achieved by analyzing the interactions of multiple compressors operating in parallel in order to find the best phasing configuration to minimize the generated pressure pulsation in the plant. The phasing configuration is then achieved implementing it through the design of a smart start up sequence of the compressor drivers (electric motors).

Therefore embodiments of the invention allow reducing the pressure pulsation generated by multiple reciprocating compressors operating in parallel in the same plant.

As a further advantage, embodiments of the invention allow reducing the size of control devices for the reduction of pressure pulsation, namely pressure dampers, with consequent cost reduction.

Furthermore, embodiments of the invention allow reducing the concentrated pressure losses required to control pressure pulsation with consequent power efficiency increase.

BRIEF DESCRIPTION OF THE DRAWINGS

The various embodiments will now be described, by way of example, with reference to the accompanying drawings, wherein like numerals denote like elements, and in which.

DETAILED DESCRIPTION OF THE INVENTION

Exemplary embodiments will now be described with reference to the enclosed drawings without intent to limit applications and uses.

According to first exemplary embodiment, a method for reducing the pulsation level in a multi-compressor plant where each compressor of a plurality of compressors is driven by a respective motor, is disclosed. The disclosed method manages to reduce the pulsation level by starting a first motor of a first compressor and then starting in succession each one of the other motors in a way to synchronize all motors between each other with a specified and predetermined phase shift More specifically, embodiments of the invention will be now described with reference to a plant provided with four reciprocating compressors 100 wherein each reciprocating compressor 100 has six double-acting cylinders 140-145 divided in two balanced opposed banks. This configuration is only a non-limitative example of the embodiments of the invention, being it possible to apply the embodiments of the method of the invention to different plants and/or different compressors configurations and types, for instance to reciprocating compressors provided with single-acting cylinders.

Figure 13:
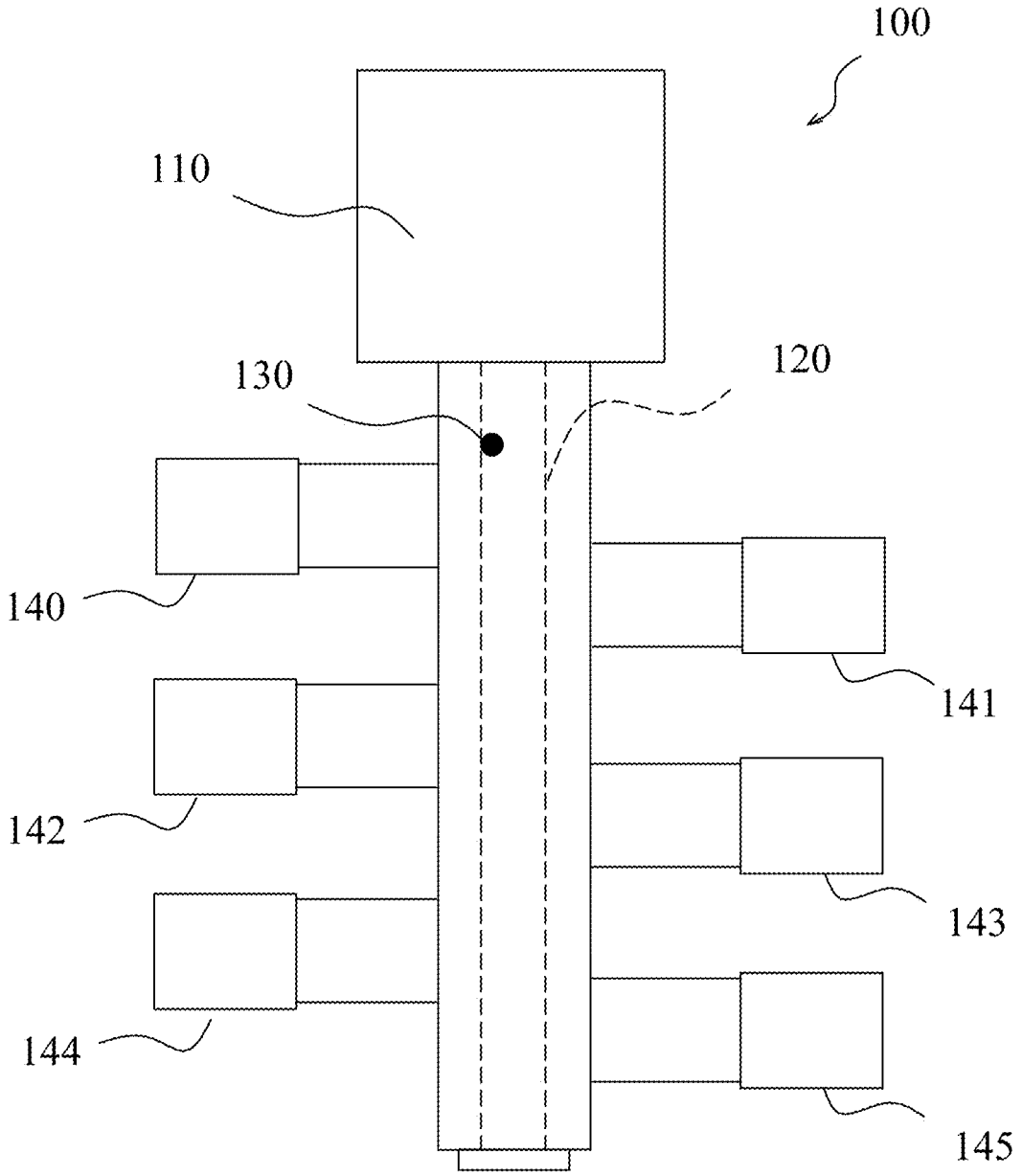
FIG. 13 is a schematic plant view of a six double-acting cylinders compressor.

A reciprocating compressor 100 having six double-acting cylinders 140-145 divided in two balanced opposed banks is schematically represented in FIG. 13.

FIG. 13 describes a reciprocating compressor 100 which has a motor 110 connected to a motor shaft 120, the motor shaft 120 being in turn connected by means of crankshafts to six double-acting cylinders 140-145. The motor 100 can be a synchronous electrical motor.

Preferably, a position sensor 130, for example an inductive sensors, placed on the motor shaft 120 in order to monitor the rotation position, i.e. the phase of the motor shaft 120.

The multi-compressor plant comprises a plurality of reciprocating compressors 100 connected to a piping system and suitable for injecting into and extracting from a reservoir natural gas.

For example, in a plant having four reciprocating compressors, each having six double-acting cylinders, there are 48 different excitations that can be activated or unloaded.

In order to find an optimal phase shift for the above case, a study was performed also considering that at each additional reciprocating compressor start-up, the phase among the reciprocating compressors, which is random, will change, thus inducing a significant change also in the pulsations sum.

Figure 1:
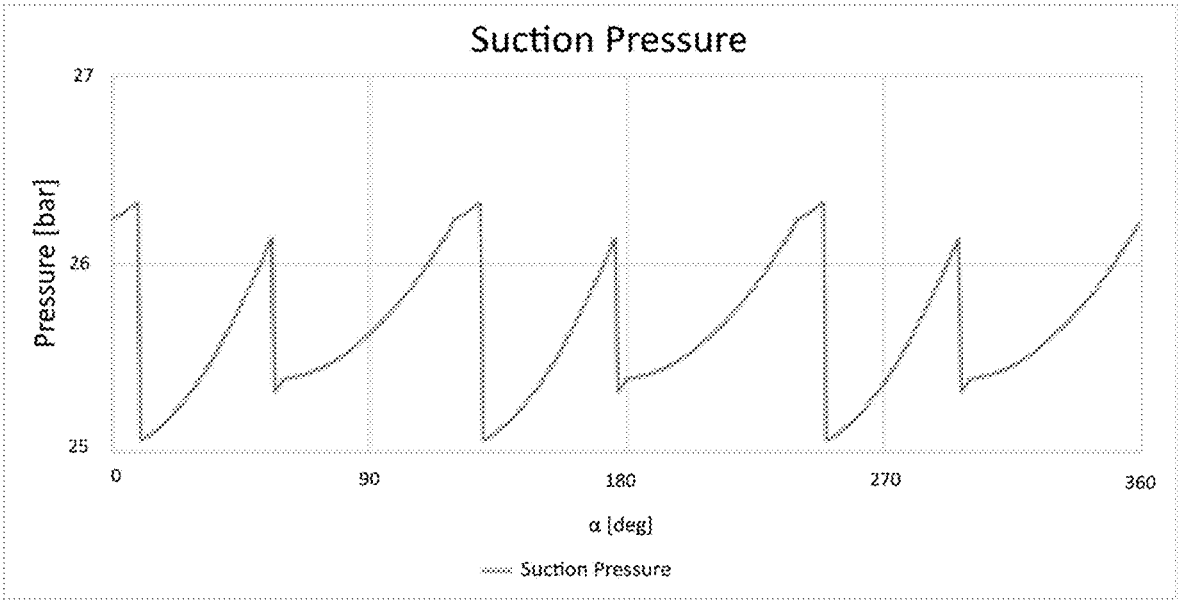
FIG. 1 shows a curve describing a suction pressure pulsation for one compressor as a function of the motor shaft rotation.
Figure 2:
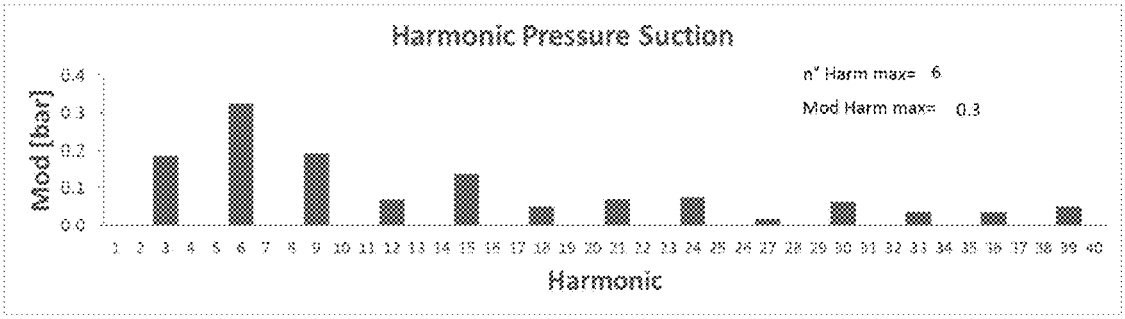
FIG. 2 is a graph that shows the relevant harmonic spectrum for the case of FIG. 1.

To maintain the study execution within reasonable time, considering that for each phase to be verified hundreds of runs must be performed, it was decided to first select the possible best phase using a pure theoretical approach neglecting plant effect. After that run the complete study only for the phase case that theoretically limited the pressure pulsation sum and relevant pulsation induced forces FIG. 1 shows a curve describing a suction pressure pulsation for one reciprocating compressor as a function of the motor shaft rotation with Peak-Peak difference approximately equal to 1.269 bar and the relevant harmonic spectrum (FIG. 2—in which the most important harmonic is the $6^{th}$) at the suction cylinder flange of a single full loaded GE model 6HG/2 compressor used for this study.

Figure 3:
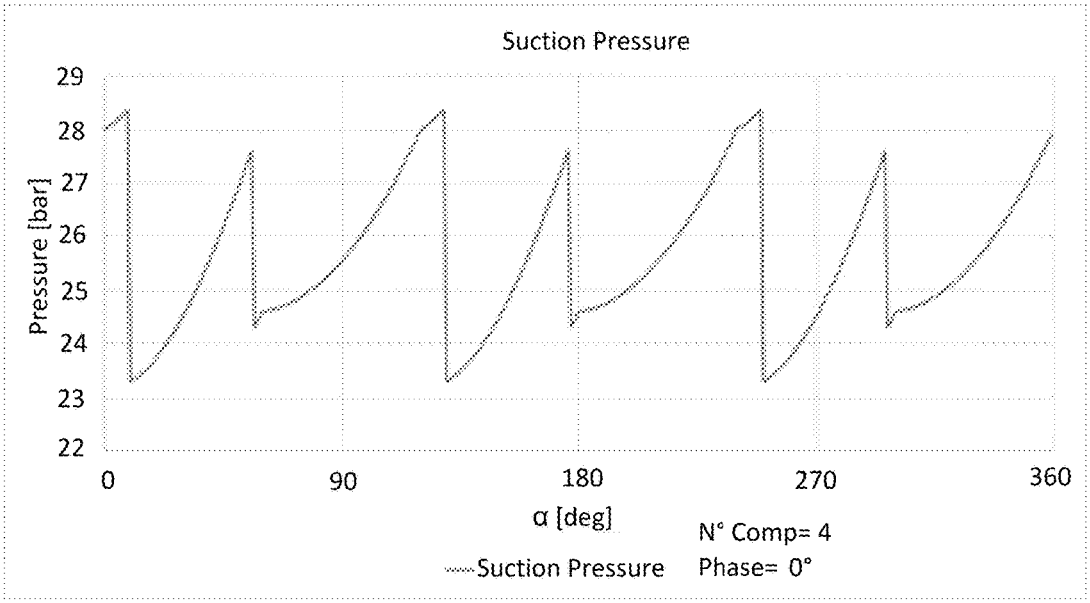
FIG. 3 shows a curve describing a theoretical suction pressure pulsation sum for four compressors at a 0° phase.
Figure 4:
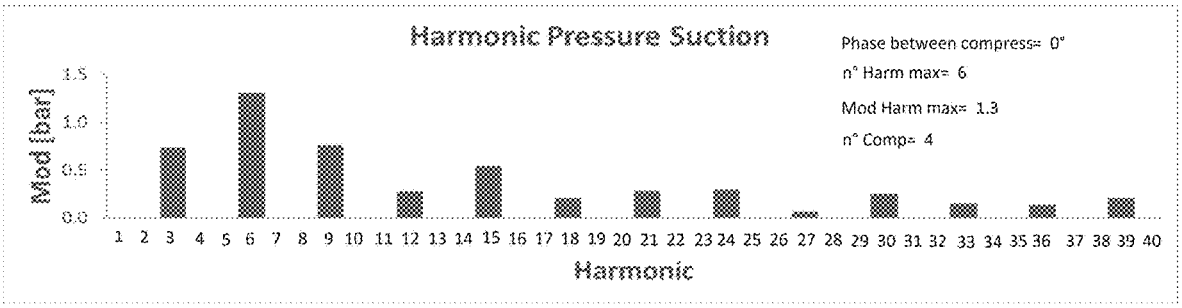
FIG. 4 is a graph that shows the relevant harmonic spectrum for the case of FIG. 3.

FIG. 3 shows the theoretical possible pressure pulsation sum (Peak-Peak 5,077 bar), assuming all four compressors working with crankshaft in phase and direct connection among the cylinders without the plant contribute, for the suction manifold of the four fully loaded 6HG/2 compressors, while FIG. 4 illustrates the relevant harmonic spectrum for the case of FIG. 3 in which the most important harmonic is the $6^{th}$.

Comparing the theoretical pressure pulsation of one compressor (FIG. 1 and FIG. 2) with four compressors at the full load at 0°, (FIGS. 3 and 4), it is evident that the Peak-Peak pressure increases in function of the number of the compressors (Peak-Peak 1.269 bar vs. 5.077 bar which is an increase of approximately four times).

Figure 5:
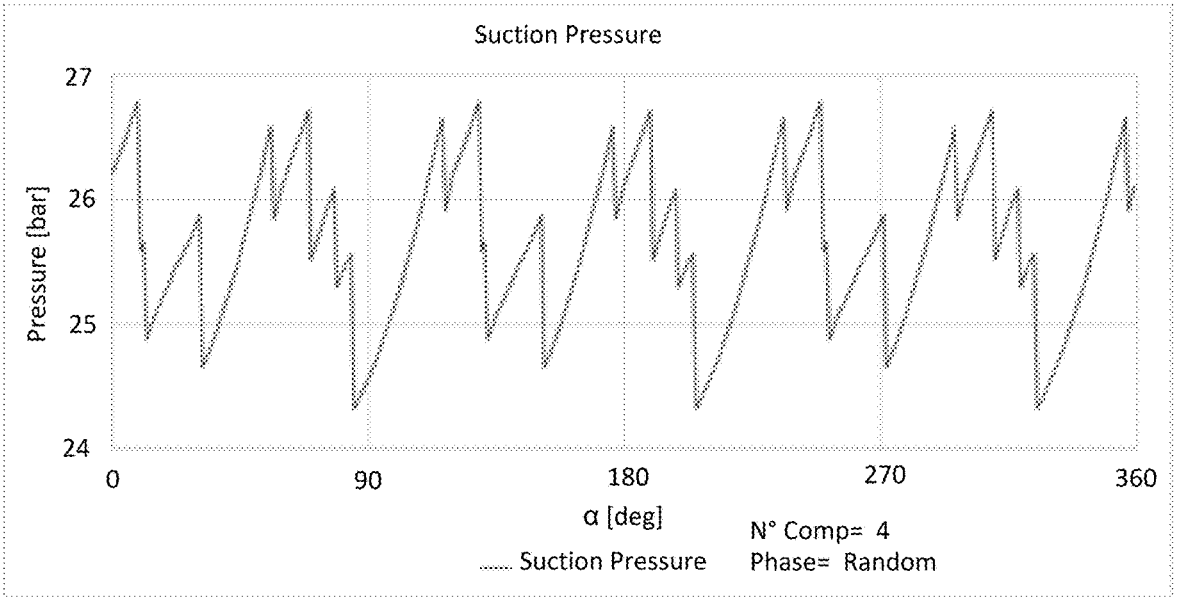
FIG. 5 shows a curve describing a theoretical suction pressure pulsation sum for four compressors at a random phase.

FIG. 5 shows the pressure sum and its harmonic spectrum for four full loaded 6HG/2 compressors with a random start. Comparing the results of FIG. 3 with FIG. 5, the peak-peak pressure is lower (Peak-Peak 2.469 bar vs. 5.077 bar).

Figure 6:
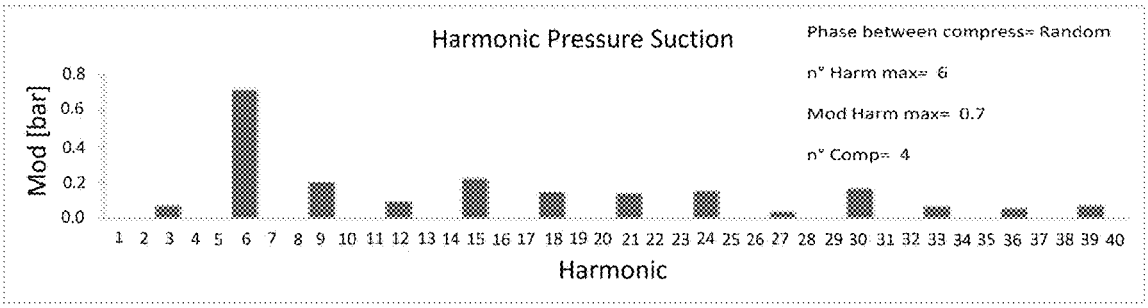
FIG. 6 is a graph that shows the relevant harmonic spectrum for the case of FIG. 5.

FIG. 6 shows how the harmonic spectrum changes leading to a different harmonics distribution, in particular an harmonic distribution with lower harmonic modules.

It must be noted that the main problem of a random start up sequence is that It creates, at every start up, uncertainty concerning the stresses imposed to the plant.

Several different random starts have been studied giving rise to different suction pressure curves, but in each case the peak-peak pressure is lower with respect to the worst theoretical case.

Figure 7:
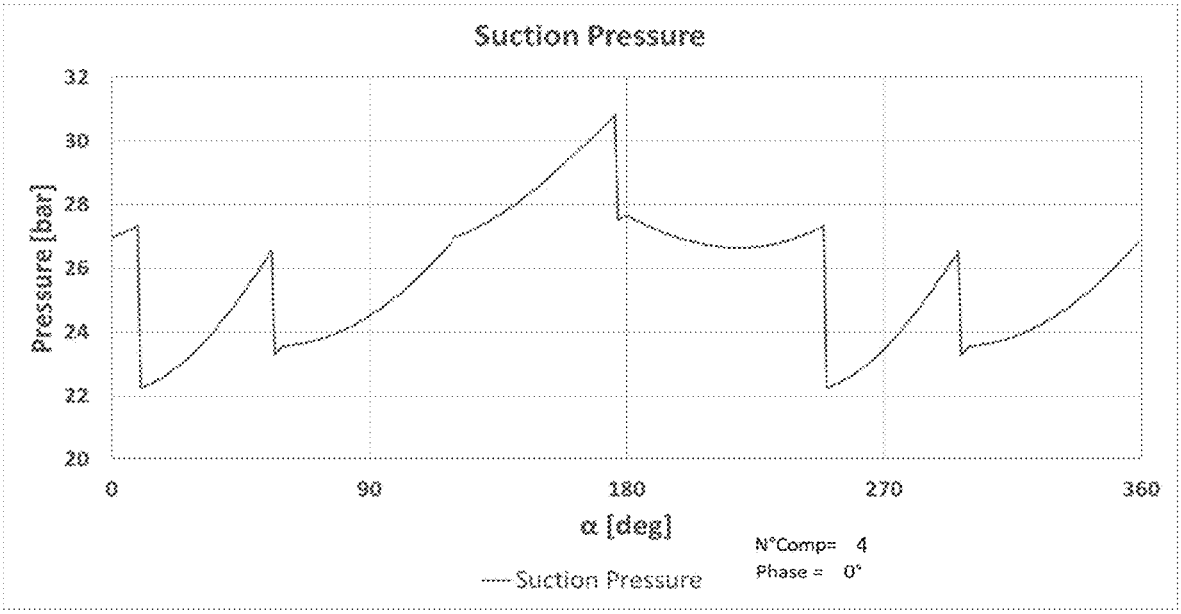
FIG. 7 shows a worst case scenario for the suction pressure pulsation sum for four compressors.

In fact, analyzing several cases with various loads, the worst theoretical possible pressure pulsation sum was discovered (see FIG. 7 that shows a Peak-Peak difference of 8.594 bar).

This is relevant to four reciprocating compressors working with crankshaft in phase at 83% of load.

Figure 8:
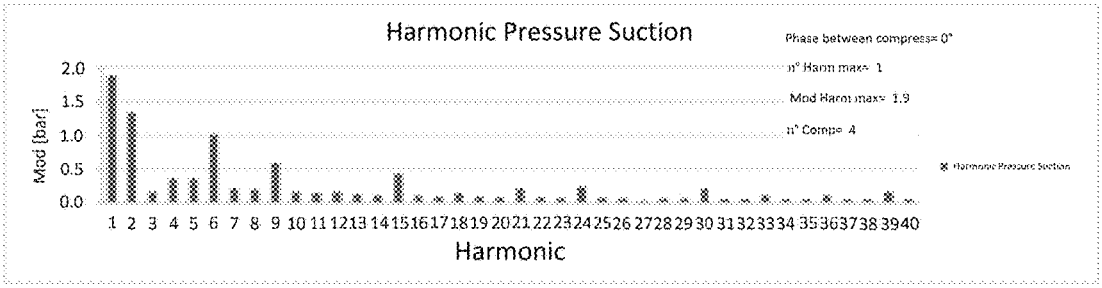
FIG. 8 is a graph that shows the relevant harmonic spectrum for the case of FIG. 7.

FIG. 8 describes a different pulsation spectrum with 1st harmonic main component.

This is particularly worrisome because this harmonic can be filtered in a less efficient way by known pressure control dampers.

All the above theoretical examples of phase among the reciprocating compressors operating in parallel clearly indicated that the pulsation sum change at each start up and capacity control. The use of the traditional approach of worst case sum in this complex application, may lead to conservative recommendations on supports and structure requirements. At the same time using a more relaxed approach (e.g. considering only the forces due to a single compressor), the uncertainty due to the random start-up phase may lead to underestimate the real pulsation induced forces. This in cascade may lead to underestimate the relevant piping supports requirements resulting in excessive piping vibrations. So, the worst-case pulsation sum remains the only way to properly control the phenomena. At the same time, the above theoretic examples indicated that adopting a specific phase the pulsation sum may be reduced.

Another important refined acoustic solution can be introduced. This is achieved by investigation of the best phasing among the reciprocating compressor shafts to efficiently control the pressure pulsation sum, considering all possible combination cases of operation, and then finding a way to impose reciprocating compressors crankshaft phase, eliminating the described random start-up uncertainty.

To find the best phase among the 4 compressors, in a so complex application, it is necessary to identify the player of the interactions, here below listed:

- The compressor model is GE 6HG/2 which has 6 cylinders (double-acting) divided into two balanced opposed banks. Each bank has 3 cylinders at 120° between them. Each compressor taken individually at full load is perfectly balanced having distributed the cylinders every 120°;
- There are several capacity controls, that excluding the various effects, generate several different harmonic components;
- Normal operation is 4 compressors operating in parallel, however also the condition with 1, 2 and 3 compressors must be verified and considered for the phase selection.

Considering that the case to be optimized is with 4 compressors, the theoretical exercise was repeated with various reciprocating compressors phase shifting. This simplified analysis lead to choose 90° (see FIG. 11, with 4 compressors at 83% of load) as better phase among the crankshafts of the compressors for all the operating cases.

Figure 11:
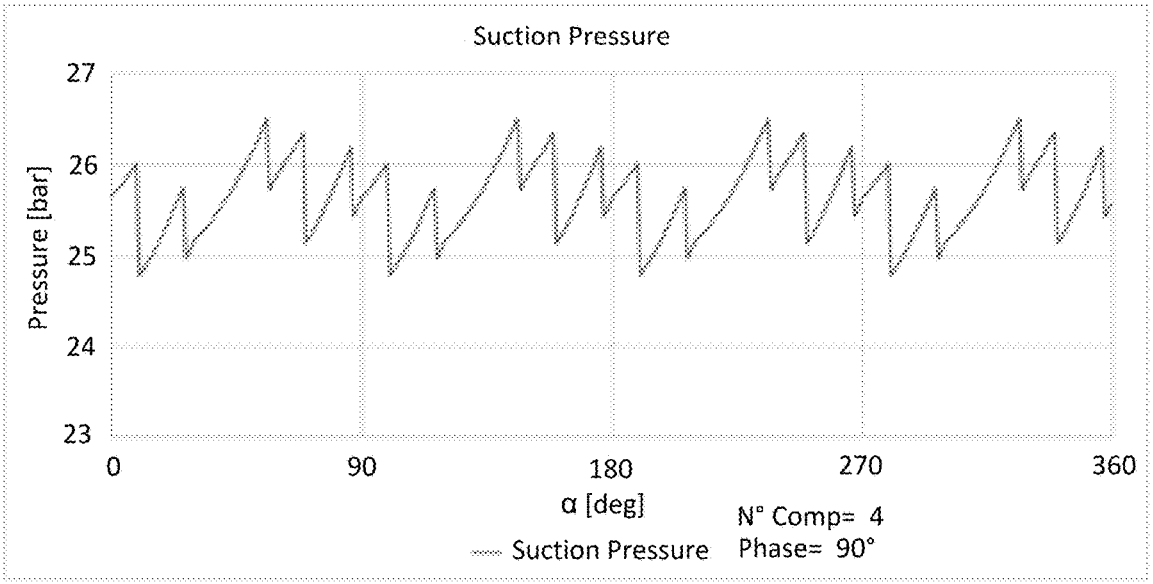
FIG. 11 shows an optimized case scenario for the suction pressure pulsation sum for four compressors at a 83% load, according to an embodiment of the invention.
Figure 12:
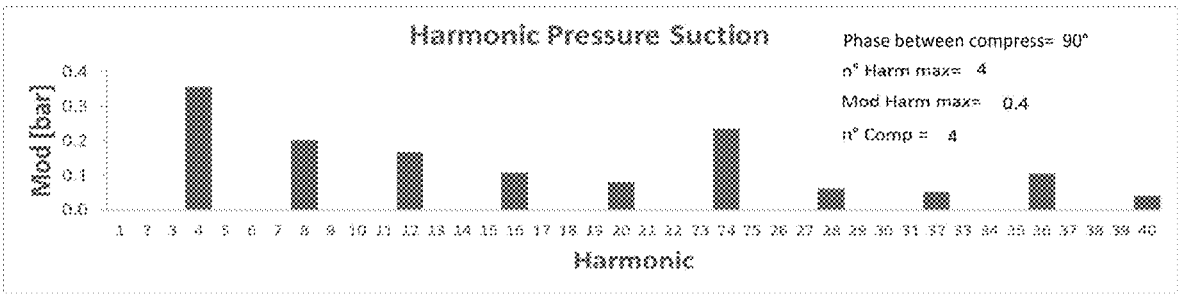
FIG. 12 is a graph that shows the relevant harmonic spectrum for the case of FIG. 9.

FIG. 12 shows the relevant harmonic spectrum for the case of FIG. 11.

Comparing this with the worst theoretical case depicted in FIG. 7, it can be noted that the reduction of pressure pulsations sum is significant (1.721 bar peak-to-peak vs 8,594 bar).

The analysis continues investigating also all the other cases with a reduced number of compressors and partial loads conditions.

Figure 9:
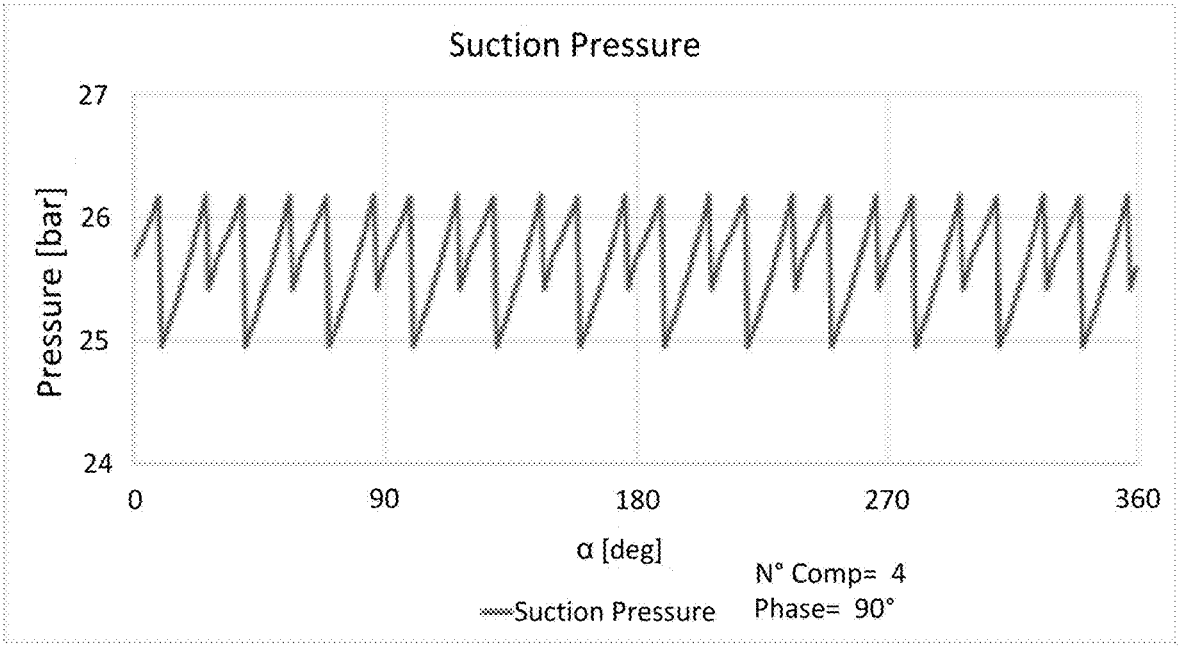
FIG. 9 shows an optimized case scenario for the suction pressure pulsation sum for four compressors at a 100% load, according to an embodiment of the invention.
Figure 10:
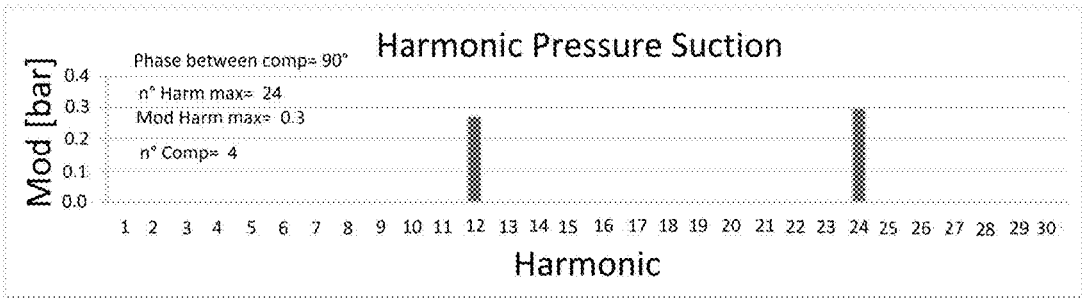
FIG. 10 is a graph that shows the relevant harmonic spectrum for the case of FIG. 9.

FIG. 9 for example shows an optimized case scenario for the suction pressure pulsation sum for four compressors at a 100% load and 90° phase. FIG. 10 is a graph that shows the relevant harmonic spectrum for the case of FIG. 9.

In this case the suction pressure curve is more distributed with peak-to-peak vale of 1.2 bar and an harmonic spectrum with dominant harmonics the $12^{th}$ and the $24^{th}$ harmonic so obtaining an optima balancing for a system with 48 different excitations.

This simplified analysis indicated that, the 90° phase is the best solution also for the condition with three active compressors. Theoretically, one could think that the best phasing with three compressors crankshafts is 120°, but considering the total number of cylinders present, the phase between them and the number of active effects (forward and backward), the 120° phasing leads to a configuration equal to the condition with 0° phase, that is already identified as the worst-case sum. To be noted that the various simulations performed indicated that for some capacity control cases the optimal phase was 45°, but under the others cases the 45° phase is worse than 90°. The exercise was repeated for two compressors running and also in this parallel operation the best phase was at 90°.

The conclusion of the theoretical exercise, done for the various part of plant, is that the resulting best phase is 90°.

The following Table 1 recapitulates the peak to peak values and the harmonic values studied and discussed.

TABLE 1

| N° of compressors | 1 | 4 | 4 | 4 | 4 | 4 | 4 |
|---|---|---|---|---|---|---|---|
| Phase between compressors | | Random | Random | 0° | 0° | 90° | 90° |
| Regulation | | 100% | 100% | 100% | 83% | 100% | 83% |
| Suction Peak to Peak (bar) | 1.3 | 2.5 | 3.3 | 5 | 8.6 | 1.2 | 1.7 |
| Suction Maximum harmonic | 6 | 6 | 9 | 6 | 1 | 24 | 4 |
| Suction Maximum harmonic module (bar) | 0.3 | 0.7 | 0.7 | 1.3 | 1.9 | 0.3 | 0.3 |
| Discharge Peak to Peak (bar) | 5.8 | 9 | 13 | 23.4 | 23.4 | 5.6 | 8.5 |
| Discharge Maximum harmonic | 3 | 6 | 9 | 3 | 3 | 24 | 4 |
| Discharge Maximum harmonic module (bar) | 1.3 | 1.6 | 3.3 | 5.3 | 4.7 | 1.2 | 2.1 |

In view of the above analysis, an embodiment of the method of the invention comprises a step of starting a first motor 110 of a first compressor 100 and a step of starting in succession each other motors 110 in order to synchronize all motors 110 between each other with a specified phase shift.

As stated above, or the case examined, the specified phase shift between compressors is 90°.

The step of synchronizing all motors 110 between each other with the above specified phase shift is performed by coupling the compressor crankshafts with the respective motor shafts 110 with specific mechanical shifts (0° for 1st system, 90° for 2nd one, 180° for 3rd one and 270° for 4th one) based on pulsation study results in order to perform a smart start up sequence.

The step of synchronizing all motors 110 between each other with a specified phase shift is performed by starting each successive motors 110 on the same pole of the already running motors 110.

Figure 14:
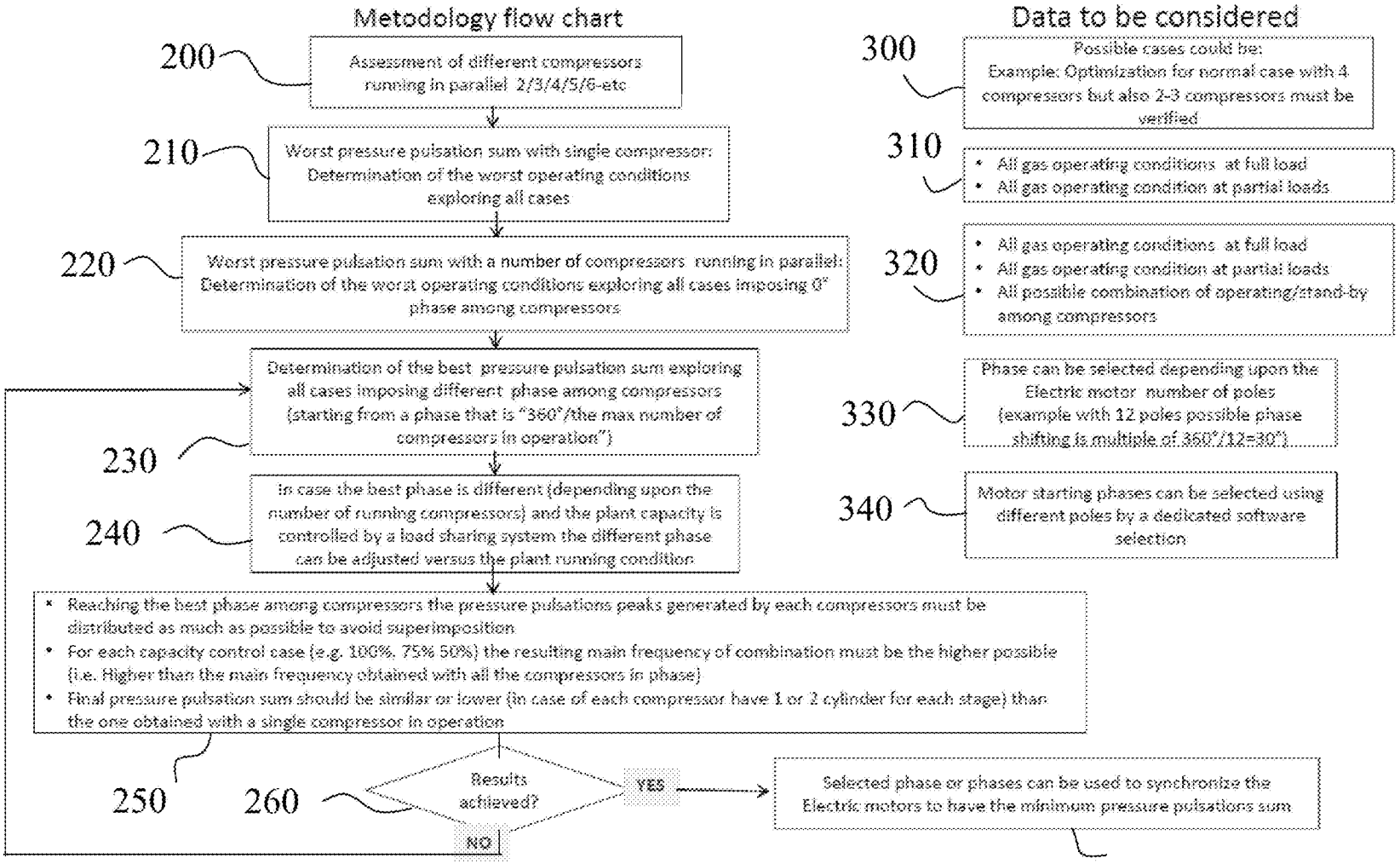
FIG. 14 shows a flowchart of an example embodiment of the method of the invention.

FIG. 14 shows a flowchart of an embodiment of the method of the invention and of the data to be considered.

A first step of the method may comprise the assessment of a number of compressors running in parallel, such as 2/3/4/5/6 or more (block 200).

As mentioned before, possible cases for the application of the method described may, for example, an optimization for a normal case with 4 compressors but also 2-3 compressors can be verified (block 300).

Then a step of determining the worst pressure pulsation sum using a single compressor is performed by the determination of the worst operating conditions exploring all cases (block 210).

Data to be considered may comprise all gas operating conditions at full load and/or all gas operating condition at partial loads (block 310).

Then a step of worst pressure pulsation sum with different compressors running in parallel is performed by the determination of the worst operating conditions exploring all cases imposing 0° phase among compressors (block 220).

Data to be considered may comprise all gas operating conditions at full load, all gas operating condition at partial loads and all possible combination of operating/stand-by among compressors (block 320).

Then a step of determination of the best pressure pulsation sum exploring all cases imposing a different phase among compressors starting from a phase that is equal to $360°/N_c$, wherein $N_c$ is the maximum number of compressors in operation (block 230).

The phase can be selected depending as a function of the electric motor number of poles (for example with 12 poles the possible phase shifting is a multiple of 360°/12=30°) (block 330).

In case the best phase is different (depending upon the number of running compressors) and the plant capacity is controlled by a load sharing system, the different phase can be adjusted versus the plant running condition (block 240).

It is to be noted that motor starting phases can be selected using different poles by a dedicated software selection (block 340).

Then a step of reaching the best phase among compressors wherein the pressure pulsations peaks generated by each compressors must be distributed as much as possible to avoid superimposition is performed For each capacity control case (e.g. 100%, 75% 50%) the resulting main frequency of combination must be the higher possible (i.e. Higher than the main frequency obtained with all the compressors in phase)

The final pressure pulsation sum should be similar or lower (in case of each compressor have 1 or 2 cylinder for each stage) than the one obtained with a single compressor in operation (block 250).

Then a check to verify if the desired results are achieved is performed (block 260).

If the answer to this check is negative, a new a step of determination of the best pressure pulsation sum exploring all cases, imposing a different phase among compressors, is performed as in block 230.

On the contrary, if the answer is positive, the selected phase or phases can be used to synchronize the electric motors in order to have the minimum pressure pulsations sum (block 270).

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments. The description of exemplary embodiments refer to the accompanying drawings. The same reference numbers in different drawings identify the same or similar elements. The present detailed description does not limit the invention. Instead, the scope of the invention is defined by the appended claims.

The invention claimed is:

1. A method for reducing a pressure pulsation level in a multi-compressor plant, the multi-compressor plant comprising a plurality of reciprocating compressors connected in parallel to a gas piping system, each reciprocating compressor being driven by a respective motor, the method comprising:

assessing a number of reciprocating compressors running in parallel;

determining a worst operating condition of a single reciprocating compressor of the plurality of reciprocating compressors running by determining a highest peak-to-peak value for a pressure pulsation sum of the single reciprocating compressor of the plurality of reciprocating compressors running;

determining a worst operating condition imposing 0° phase among the plurality of reciprocating compressors running in parallel by determining a highest peak-to-peak value for a pressure pulsation sum of the plurality of reciprocating compressors running in parallel;

determining a lowest pressure pulsation sum imposing a different phase among the plurality of reciprocating compressors starting from a phase that is equal to 360°/Nc, wherein Nc is a maximum number of reciprocating compressors in operation;

determining a best phase shift among the plurality of reciprocating compressors when a pressure pulsations peaks generated by each reciprocating compressor is distributed so as to avoid superimposition under a condition that, for each capacity control case, a resulting main frequency of combination is a highest possible;

starting a first motor of a first reciprocating compressor of the plurality of reciprocating compressors; and starting in succession each other motor and synchronizing all of the motors between each other with the determined best phase shift by coupling the reciprocating compressor crankshafts with respective motor shafts with respective mechanical shifts.

2. The method according to claim 1, wherein the step of synchronizing all motors between each other with the determined best phase shift is performed by starting each successive motors on a same pole of the already running motors.

3. The method according to claim 1, wherein an exact position of each shaft of each motor is determined by means of a position sensor placed on each motor shaft.

4. The method according to claim 1, wherein each reciprocating compressor is provided with double-acting cylinders.

5. The method according to claim 4 wherein the determined best phase shift between reciprocating compressors is comprised between 0° and 180°.

6. The method according to claim 4, wherein the multi-compressor plant is provided with four reciprocating compressors and each reciprocating compressor has six double-acting cylinders divided in two balanced, opposed banks.

7. The method according to claim 6, wherein the determined best phase shift between reciprocating compressors is 90°.

8. The method according to claim 1, wherein each reciprocating compressor is provided with single-acting cylinders.

9. The method according to claim 8 wherein the determined best phase shift between reciprocating compressors is comprised between 0° and 360°.

10. The method according to claim 1, wherein the plurality of reciprocating compressors connected in parallel to the gas piping system are configured for injecting into and extracting from a reservoir natural gas.

11. The method according to claim 1, wherein the method is performed by action on synchronous electrical motors.

* * * * *